US012433456B2

(12) United States Patent
Yang et al.

(10) Patent No.: US 12,433,456 B2
(45) Date of Patent: Oct. 7, 2025

(54) CHILD TOILET ASSEMBLY WITH DAMPING

(71) Applicant: XIAMEN JOPEO CO., LTD., Fujian (CN)

(72) Inventors: Bin Yang, Fujian (CN); Qi Chen, Fujian (CN); Xiang Ye Lin, Fujian (CN)

( * ) Notice: Subject to any disclaimer, the term of this patent is extended or adjusted under 35 U.S.C. 154(b) by 348 days.

(21) Appl. No.: 18/143,078

(22) Filed: May 4, 2023

(65) Prior Publication Data

US 2024/0188769 A1 Jun. 13, 2024

(30) Foreign Application Priority Data

Dec. 12, 2022 (CN) ..... 202223337695.1

(51) Int. Cl.
*A47K 13/06* (2006.01)

(52) U.S. Cl.
CPC ..... *A47K 13/06* (2013.01)

(58) Field of Classification Search
CPC ..... A47K 13/06; A47K 13/28; A47K 13/04; A47K 13/005; A47K 13/12; A47K 13/24; A47K 13/26
See application file for complete search history.

(56) References Cited

U.S. PATENT DOCUMENTS 5,448,781 A * 9/1995 Miller ..... A47K 13/06 16/259
6,449,780 B1 * 9/2002 Merry ..... A47K 13/06 4/235
7,647,652 B1 * 1/2010 Baker ..... A47K 13/12 4/236
7,845,027 B2 * 12/2010 Er ..... A47K 13/12 4/240
9,538,888 B2 * 1/2017 Chen ..... A47K 13/26

* cited by examiner

*Primary Examiner* — Erin Deery
(74) *Attorney, Agent, or Firm* — Birchwood IP

(57) ABSTRACT

A novel toilet seat structure, including a supporting base, a toilet seat, fixing blocks and two first buffered-descent modules; the toilet seat includes a child seat that has a child seat body and a first decorative lid; a rear end of the child seat body is provided with a shaft portion including first shaft sleeves and a sliding groove; the first decorative lid is detachably fitted with an opening part of the sliding groove; two ends of the supporting base are provided with second shaft sleeves respectively; a fixing block is embedded inside and being limited from rotating circumferentially in each second shaft sleeve; each first buffered-descent module is embedded inside the shaft portion through the sliding groove, and then passes through a corresponding first shaft sleeve and is then connected to a corresponding fixing block.

10 Claims, 11 Drawing Sheets

CHILD TOILET ASSEMBLY WITH DAMPING

FIELD OF THE INVENTION

The present invention relates to the field of toilet seats, and more particularly a novel toilet seat structure.

BACKGROUND OF THE INVENTION

A toilet seat is a general term for an upper lid and an oval seat of a toilet bowl, which is sometimes provided with a child seat for ease of small children using the toilet; the upper lid, the oval seat and the child seat are all pivotally installed to a supporting base of the toilet.

In the prior art, the upper lid, the oval seat and the child seat are provided with shaft sleeves on their rear parts respectively, and the shaft sleeves share a common shaft pin with the supporting base to form a pivotal fit. When the child seat is no longer needed as children grow up, the child seat becomes redundant and causes inconvenience for cleaning, and there is thus a demand for detachable child seats on the market; meanwhile, the child seat in the prior art is not capable of buffered descent, which is prone to descending quickly and producing loud noise when being used by children, and causing children to be frightened or hurt.

The assembly structure of child seats on the market is usually only able to achieve either a detachable structure or a buffered descent structure; it is very rare that a child seat can be both detachable and capable of buffered descent.

BRIEF SUMMARY OF THE INVENTION

It is an object of the present invention to provide a novel toilet seat structure with a quick disassembling child seat, and being capable of buffered descent.

To attain the above object, the technical solutions of the present invention are as follows:

A toilet seat structure, comprising a supporting base, a toilet seat, fixing blocks and two first buffered-descent modules; the toilet seat comprises a child seat; the child seat comprises a child seat body and a first decorative lid; a rear end of the child seat body is provided with a shaft portion in a hollow structure; the shaft portion comprises two first shaft sleeves provided at two ends of the shaft portion respectively, and a sliding groove provided between the two first shaft sleeves; the first decorative lid is detachably fitted with an opening part of the sliding groove; each of two ends of the supporting base is provided with a second shaft sleeve respectively; each second shaft sleeve is embedded with a corresponding fixing block; each fixing block is circumferentially limited by a corresponding second shaft sleeve; the two first buffered-descent modules are embedded inside the shaft portion through the sliding groove; each of the first buffered-descent modules passes through a corresponding first shaft sleeve at one of two ends of the sliding groove, and is connected to one side of a corresponding fixing block, thus enabling each first shaft sleeve and a corresponding second shaft sleeve to form a buffered-descent connection.

When the child seat body is in a closed state, the opening part of the sliding groove is facing downward.

At least one first buckle groove is provided on each of two sides of the sliding groove along an axial direction thereof; the first decorative lid is provided with first buckles each matching with a corresponding first buckle groove; each of the first buckles to a corresponding first buckle groove.

Two limiting boards are symmetrically arranged on an inner side of the first decorative lid corresponding to first ends of the two first buffered-descent modules respectively.

A guiding rib is provided on each of two side walls of each fixing block respectively; a guiding groove matching with a corresponding guiding rib is provided on each of two inner side walls of each second shaft sleeve; each guiding rib is slidable in a corresponding guiding groove; a second buckle groove is provided on a bottom side of each fixing block; a second buckle matching with a corresponding second buckle groove is provided on a bottom wall of each second shaft sleeve; each second buckle buckles to a corresponding second buckle groove.

The toilet seat structure also comprises two second buffered-descent modules; the toilet seat further comprises an upper lid and an oval seat; a third shaft sleeve is provided on each of two sides of a rear end of the upper lid; a forth shaft sleeve is provided on each of two sides of a rear end of the oval seat; all third shaft sleeves, all forth shaft sleeves, and all second shaft sleeves are all coaxial; each third shaft sleeve and a corresponding forth shaft sleeve on a same side share one of the second buffered-descent modules which forms a buffered-descent connection with the fixing block inside a corresponding second shaft sleeve.

Preferably, the two second buffered-descent modules are any one of or a mixture of a first buffered-descent device and a second buffered-descent device; the first buffered-descent device comprises a first shaft shell filled with damping oil, and a first shaft core in a sealed rotary connection with one end of the first shaft shell, another end of the first shaft shell is provided with a first rotation shaft, a peripheral surface of the first rotation shaft is provided with a first rotation-stopping protruding edge; the second buffered-descent device comprises a second shaft shell filled with damping oil, and a second shaft core in a sealed rotary connection with one end of the second shaft shell, another end of the second shaft shell is provided with a second rotation shaft, a peripheral surface of the second shaft shell is provided with a second rotation-stopping protruding edge; an outer end of each of the first shaft core and the second shaft core is connected with another side of a corresponding fixing block respectively, wherein said another side of the corresponding fixing block is opposite to said one side of the corresponding fixing block connected with a corresponding first buffered-descent module; the two third shaft sleeves of the upper lid are fitted with the first rotation shaft and the second rotation shaft respectively; the two forth shaft sleeves of the oval seat are fitted with the first shaft shell and the second shaft shell respectively.

Preferably, sectional shapes of the outer ends of the first shaft core and the second shaft core are the same; each fixing block is provided with a splined hole which passes through two sides of said fixing block; a shape of each splined hole matches with a shape of the outer end of each of the first shaft core and the second shaft core.

Preferably, the first buffered-descent modules fitted with the child seat body are also any one of or a mixture of the first buffered-descent device and the second buffered-descent device.

The toilet seat structure further comprises second decorative lids; each second decorative lid matches with one side of a corresponding second shaft sleeve; the second decorative lids are fixed to the second shaft sleeves respectively after detaching the child seat; one side of each second decorative lid is provided with a plurality of fixing ribs which fit with inner walls of a corresponding second shaft sleeve; a bottom side of the supporting base is provided with a storage groove to store the second decorative lids.

The beneficial effects of the present invention are as follows:

1. Each of the first buffered-descent modules inside the shaft portion of the child seat body is connected with the fixing block inside a corresponding first shaft sleeve of the supporting base, so as to fix the child seat body and provide the child seat body with a buffered-descent function; the child seat is capable of buffered descent through the first buffered-descent modules, and thus will not descend quickly and produce loud noise when being used by children
2. When the child seat is not needed, a quick disassembly of the child seat can be completed by simply opening the first decorative lid, and pulling out the first buffered-descent modules along an axial direction of the sliding groove to release the shaft portion; by analogy, it is also very convenient to assemble the child seat.

DETAILED DESCRIPTION OF THE INVENTION

Figure 1:
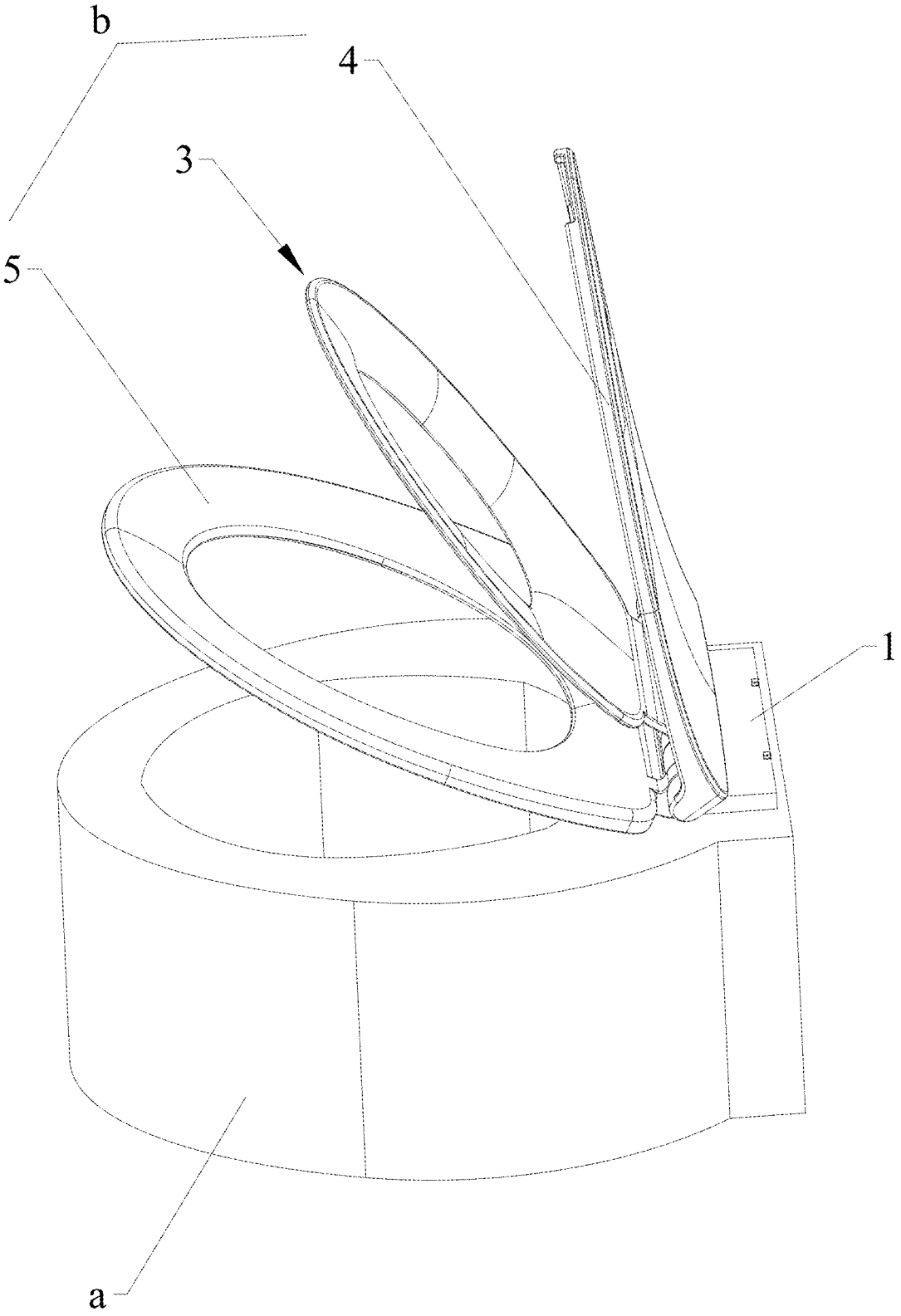
FIG. 1 shows a perspective view of the embodiment of the present invention.
Figure 2:
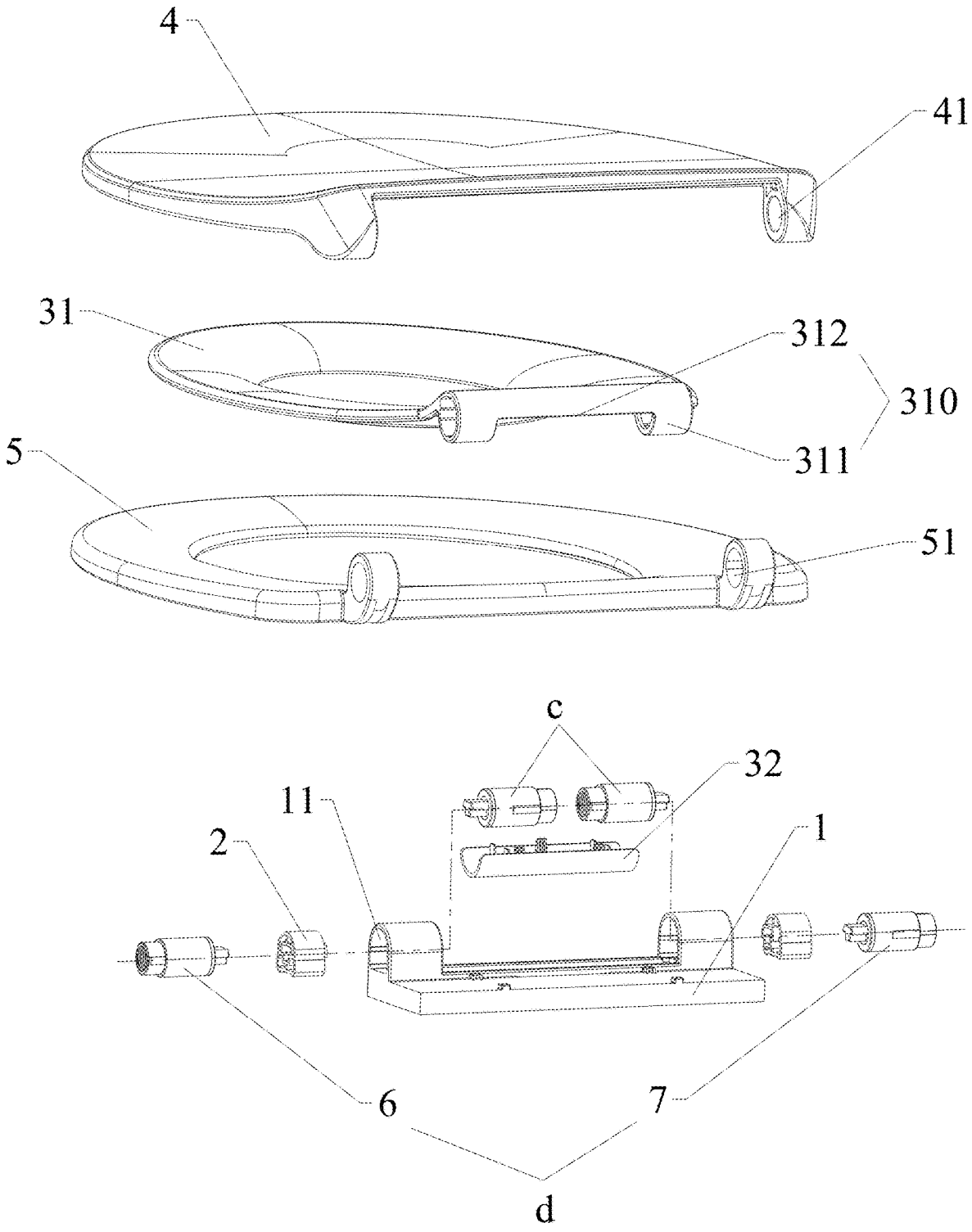
FIG. 2 shows an exploded view of the embodiment of the present invention.
Figure 3:
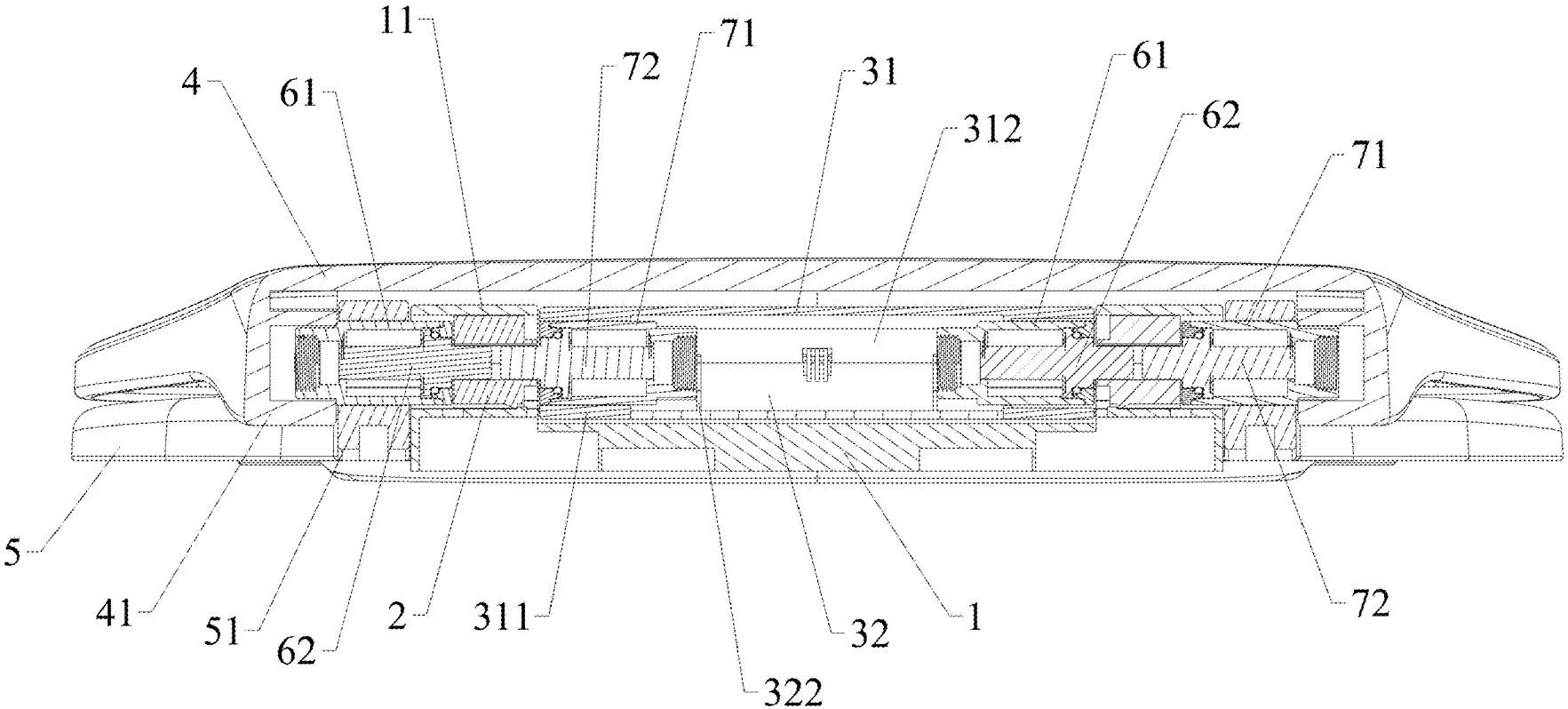
FIG. 3 shows a sectional view of the embodiment of the present invention.
Figure 4:
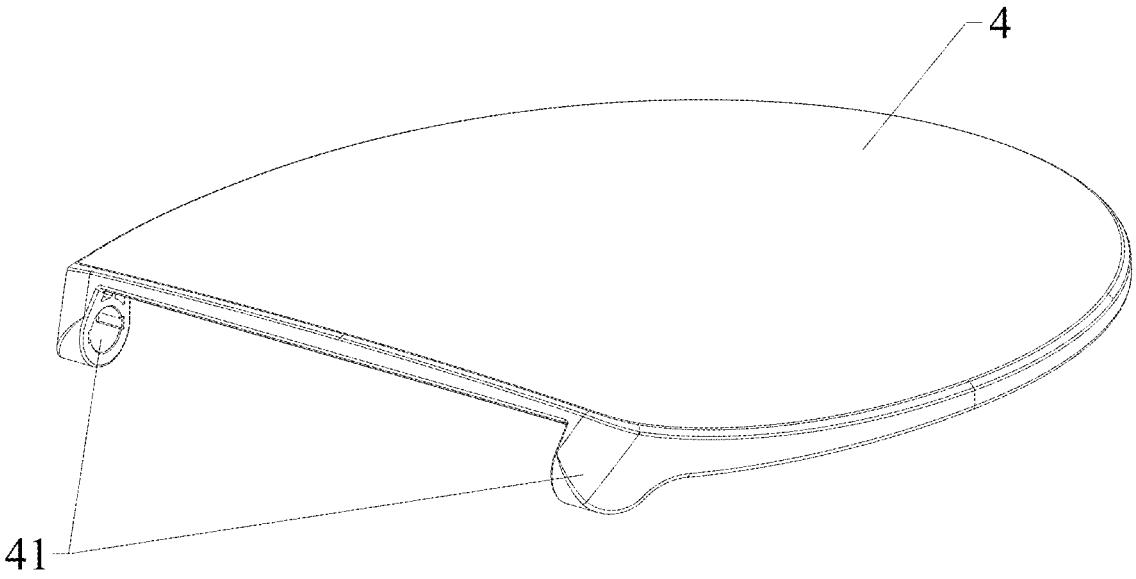
FIG. 4 shows a perspective view of the upper lid of the embodiment of the present invention.
Figure 5:
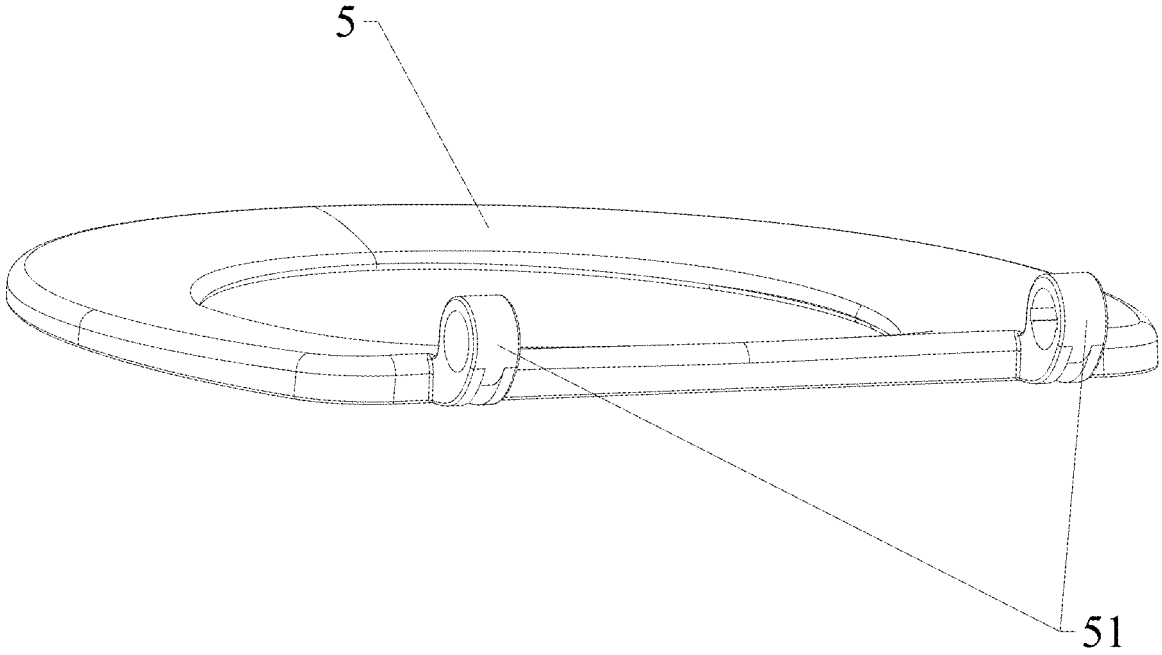
FIG. 5 shows a perspective view of the oval seat of the embodiment of the present invention.
Figure 6:
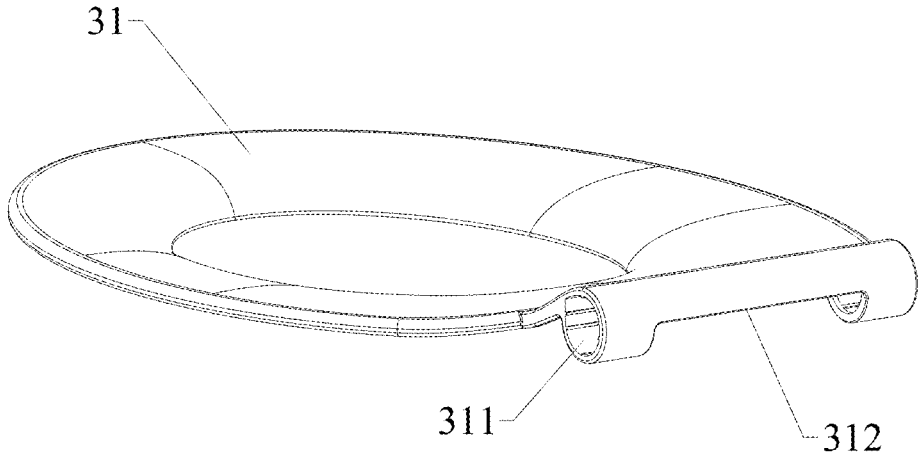
FIG. 6 shows a perspective view of the child seat body of the embodiment of the present invention in a closed state.

To further explain the technical solutions of the present invention, the following will describe in detail the present invention with reference to the specific embodiments.

As illustrated in FIGS. 1-13, the present invention discloses a novel toilet seat structure, comprising a supporting base 1 provided on a rear part of a ceramic toilet bowl body a, a toilet seat b, fixing blocks 2 and two first buffered-descent modules c;

The toilet seat b comprises child seat 3; the child seat 3 comprises a child seat body 31 and a first decorative lid 32; a rear end of the child seat body 31 is provided with a shaft portion 310 in a hollow structure; the shaft portion 310 comprises two first shaft sleeves 311 provided at two ends of the shaft portion 310 respectively, and a sliding groove 312 provided between the two first shaft sleeves 311; the first decorative lid 32 is detachably fitted with an opening part of the sliding groove 312;

Each of two ends of the supporting base 1 is provided with a second shaft sleeve 11 respectively; each second shaft sleeve 11 is embedded with a corresponding fixing block 2; each fixing block 2 is circumferentially limited by a corresponding second shaft sleeve 11;

Both first buffered-descent modules c are embedded inside the shaft portion 310 through the sliding groove 312; each of the first buffered-descent modules c passes through a corresponding first shaft sleeve 311 at one of two ends of the sliding groove 312, and is connected to one side of a corresponding fixing block 2, thus enabling each first shaft sleeve 311 and a corresponding second shaft sleeve 11 to form a buffered-descent connection.

The embodiments of the present invention are as follows:

When the child seat body 31 is in a closed state (being horizontally placed), the opening part of the sliding groove 312 is facing downward; when the child seat body 31 needs to be detached, first opening the child seat body 31 (flipping up by at least ninety degrees), so that the first decorative lid 32 fitting with the opening part of the sliding groove 312 is exposed to the user; then, removing the first decorative lid 32 and the two first buffered-descent modules c, so as to detach the child seat body 31.

Figure 7:
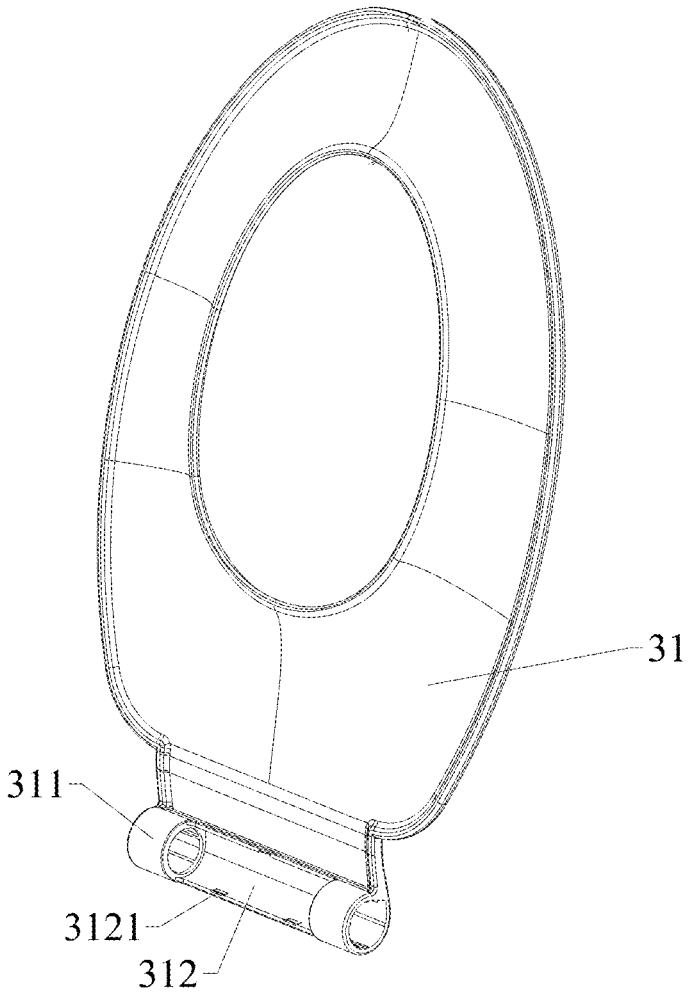
FIG. 7 shows a perspective view of the child seat body of the embodiment of the present invention in an opened state.
Figure 12:
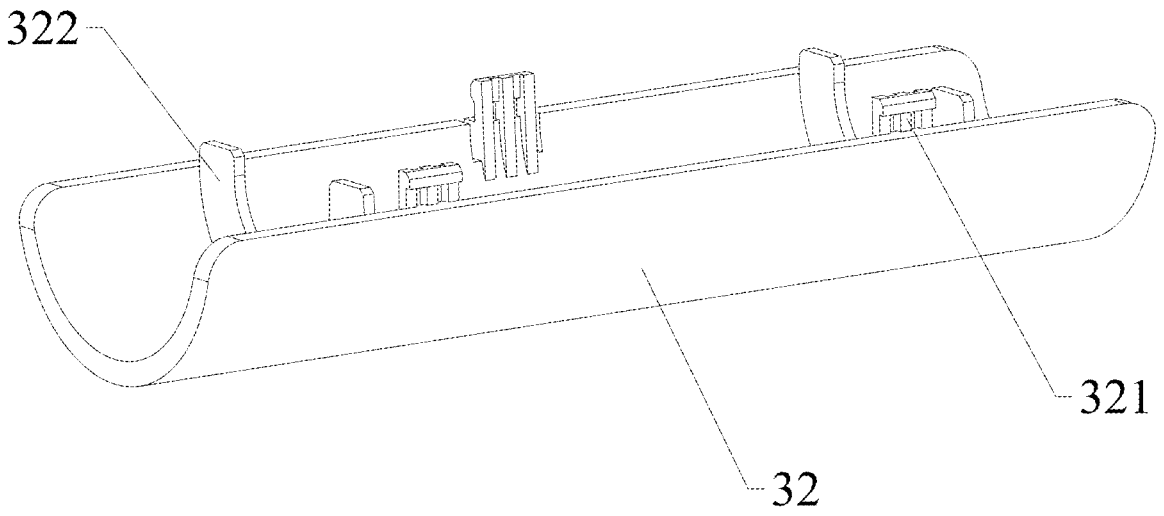
FIG. 12 shows a perspective view of the first decorative lid of the embodiment of the present invention.

At least one first buckle groove 3121 is provided on each of two sides of the sliding groove 312 along an axial direction thereof; the first decorative lid 32 is provided with first buckles 321 each matching with a corresponding first buckle groove 3121; each first buckle 321 buckles to a corresponding first buckle groove 3121 to achieve a detachable fit of the first decorative lid 32 and the sliding groove 312, so that users can quickly remove the first decorative lid 32 without tools. According to an embodiment as shown in FIG. 7, one side of the sliding groove 312 is provided with one first buckle groove 3121, and another side of the sliding groove 312 is provided with two first buckle grooves 3121; correspondingly, as shown in FIG. 12, one side of the first decorative lid 32 is provided with one first buckle 321 matching with said one first buckle groove 3121 of said one side of the sliding groove 312, and another side of the first decorative lid 32 is provided with two first buckles 321 matching with said two first buckle grooves 3121 of said another side of the sliding groove 312.

Two limiting boards 322 are symmetrically arranged on an inner side of the first decorative lid 32 corresponding to first ends of the two first buffered-descent modules c respectively. After arranging each of the two first buffered-descent modules c inside a corresponding first shaft sleeve 311, covering the opening part of the sliding groove 312 with the first decorative lid 32, so that each limiting board 322 of the first decorative lid 32 limit the first end of a corresponding first buffered-descent module c from moving axially, thus preventing dislocation of the first buffered-descent modules c.

Figure 10:
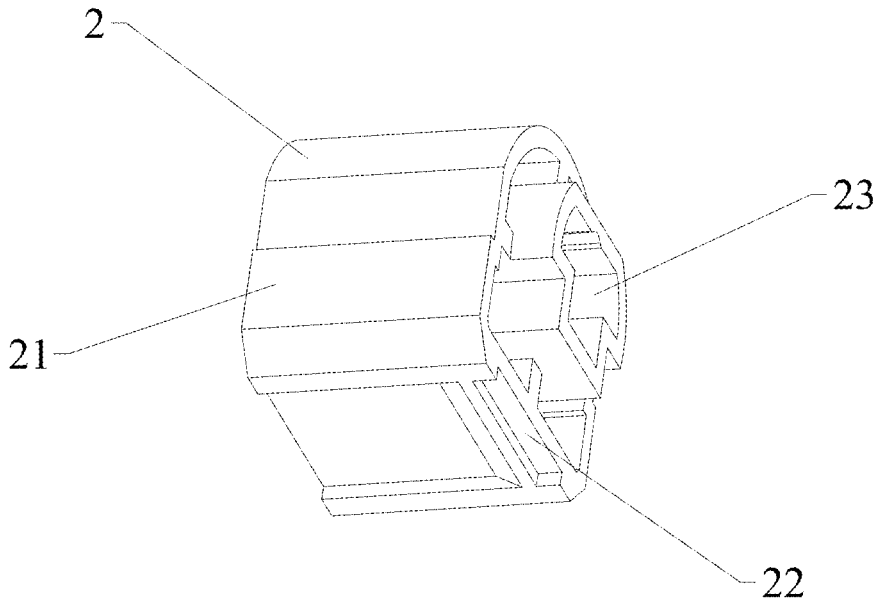
FIG. 10 shows a perspective view of the fixing block of the embodiment of the present invention.
Figure 11:
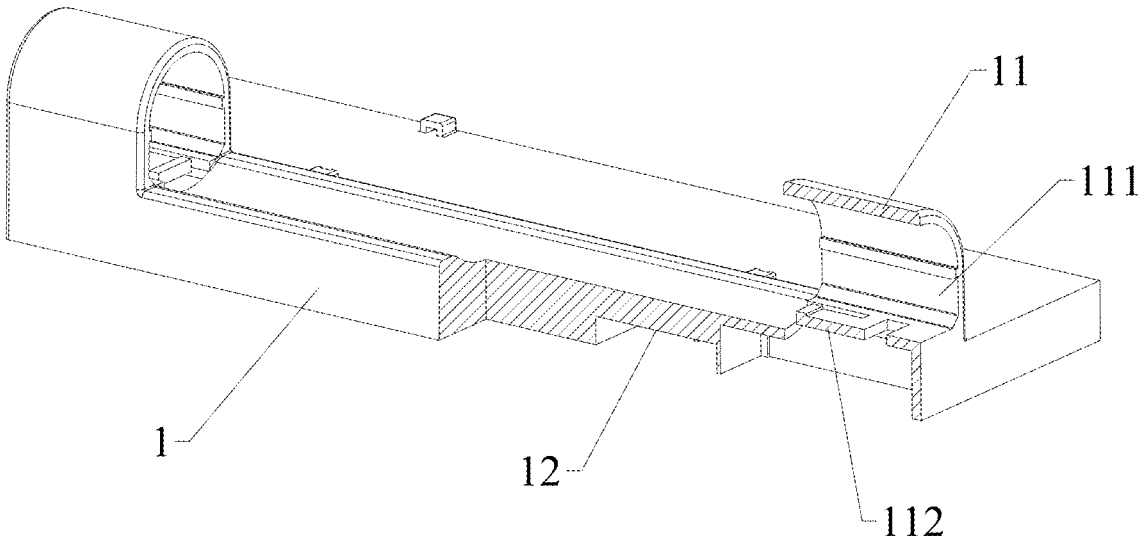
FIG. 11 shows a perspective view of the supporting base of the embodiment of the present invention.

As illustrated in FIGS. 10-11, a guiding rib 21 is provided on each of two side walls of each fixing block 2 respectively; a guiding groove 111 matching with a corresponding guiding rib 21 is provided on each of two inner side walls of each second shaft sleeve 11; each guiding rib 21 is in a sliding fit with a corresponding guiding groove 111, so as to form a sliding fit of each fixing block 2 and a corresponding second shaft sleeve 11, and limit each fixing block 2 from rotating circumferentially.

As illustrated in FIGS. 10-11, a second buckle groove 22 is provided on a bottom side of each fixing block 2; a second buckle 112 matching with a corresponding second buckle groove 22 is provided on a bottom wall of each second shaft sleeve 11; each second buckle 112 buckles to a corresponding second buckle groove 22, so as to limit each fixing block 2 from moving axially, and prevent each fixing block 2 to fall out from a corresponding second shaft sleeve 11 after fitting each fixing block 2 inside the corresponding second shaft sleeve 11.

The present invention also comprises two second buffered-descent modules d; the toilet seat b further comprises an upper lid 4 and an oval seat 5; a third shaft sleeve 41 is provided on each of two sides of a rear end of the upper lid 4; a forth shaft sleeve 51 is provided on each of two sides of a rear end of the oval seat 5; the third shaft sleeves 41, the forth shaft sleeves 51, and the second shaft sleeves 11 are coaxial; each third shaft sleeve 41 and a corresponding forth shaft sleeve 51 on a same side share one of the second buffered-descent modules d which forms a buffered-descent connection with the fixing block 2 inside a corresponding second shaft sleeve 11.

Figure 8:
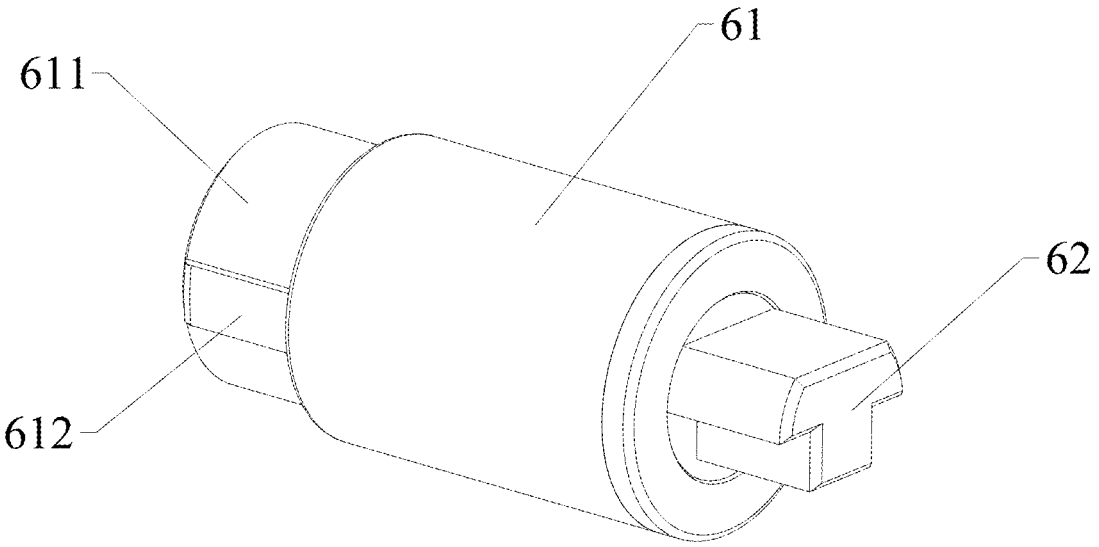
FIG. 8 shows a perspective view of the first buffered-descent device of the embodiment of the present invention.
Figure 9:
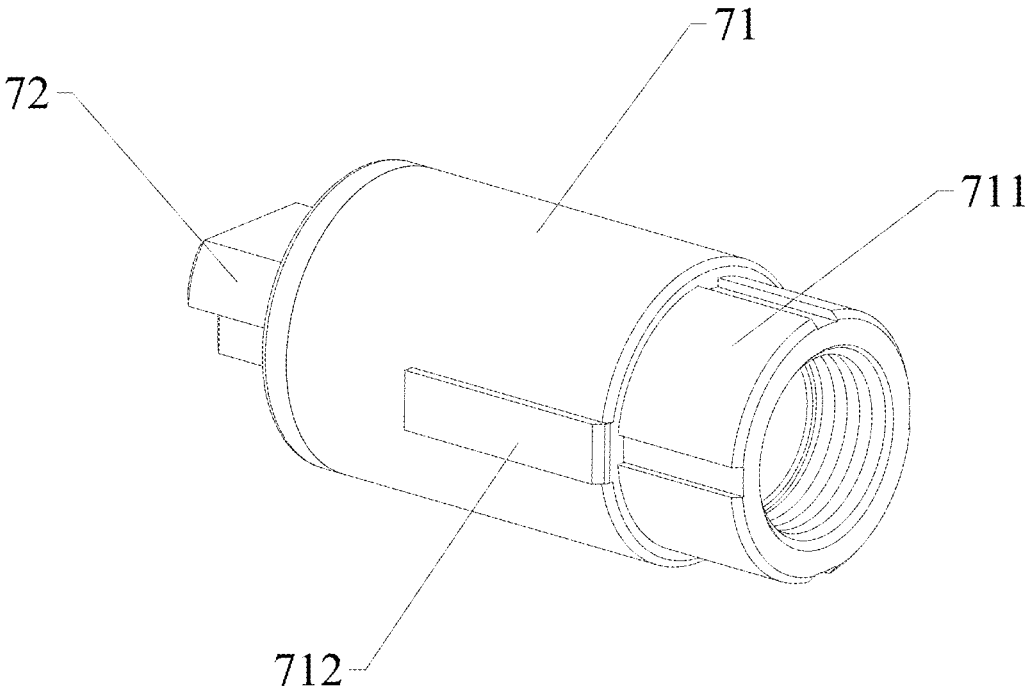
FIG. 9 shows a perspective view of the second buffered-descent device of the embodiment of the present invention.

Furthermore, the two second buffered-descent modules d are embodied as any one of or a mixture of a first buffered-descent device 6 illustrated in FIG. 8 and a second buffered-descent device 7 illustrated in FIG. 9 respectively; in other words, both the two second buffered-descent modules d are embodied as the first buffered-descent device 6, or both the two second buffered-descent modules d are embodied as the second buffered-descent device 7, or one of the two second buffered-descent modules d is embodied as the first buffered-descent device 6 while another one of the two second buffered-descent modules d is embodied as the second buffered-descent device 7; the first buffered-descent device 6 comprises a first shaft shell 61 filled with damping oil, and a first shaft core 62 in a sealed rotary connection with one end of the first shaft shell 61, another end of the first shaft shell 61 is provided with a first rotation shaft 611, a peripheral surface of the first rotation shaft 611 is provided with a first rotation-stopping protruding edge 612; the second buffered-descent device 7 comprises a second shaft shell 71 filled with damping oil, and a second shaft core 72 in a sealed rotary connection with one end of the second shaft shell 71, another end of the second shaft shell 71 is provided with a second rotation shaft 711, a peripheral surface of the second shaft shell 71 is provided with a second rotation-stopping protruding edge 712. Described below is an exemplary embodiment of one of all possible connections between the upper lid 4, the oval seat 5 and the two second buffered-descent modules d; wherein one of the second buffered-descent modules d is said first buffered-descent device 6, and another one of the second buffered-descent modules d is said second buffered descent device 7; an outer end of each of the first shaft core 62 and the second shaft core 72 is connected with another side of a corresponding fixing block 2 respectively, wherein said another side of the corresponding fixing block 2 is opposite to said one end of the corresponding fixing block 2 connected with a corresponding first buffered-descent module c; the two third shaft sleeves 41 of the upper lid 4 are fitted with the first rotation shaft 611 and the second rotation shaft 711 respectively; the two forth shaft sleeves 51 of the oval seat 5 are fitted with the first shaft shell 61 and second shaft shell 71 respectively (in the present embodiment, the third shaft sleeves 41 are arranged outside of the forth shaft sleeves 51; however, it should be understood that their positions may be exchanged so that the third shaft sleeves 41 are arranged inside of the forth shaft sleeves 51 according to which the third shaft sleeves 41 are fitted with the first shaft shell 61 and the second shaft shell 71 respectively, and the forth shaft sleeves 51 are fitted with the first rotating shaft 611 and the second rotation shaft 711 respectively). The upper lid 4 is limited from rotating circumferentially relative to the first shaft shell 61 through the first rotation-stopping protruding edge 612 of the first rotation shaft 611; since the first shaft core 62 is fixed at a corresponding fixing block 2, buffered descent function of the upper lid 4 is achieved; the oval seat 5 is limited from rotating circumferentially relative to the second shaft shell 71 through the second rotation-stopping protruding edge 712 of the second shaft shell 71; since the second shaft core 72 is fixed at a corresponding fixing block 2, buffered descent function of the oval seat 5 is achieved. The first buffered-descent device 6 and the second buffered-descent device 7 described herein are namely dampers, in which an internal structure thereof is a buffered-descent structure of buffered-descent devices (dampers) in the prior art, containing baffles, oil holes, etc., which will not be described in detail herein; a segmental design of an outer peripheral surface of each of the first buffered-descent device 6 and the second buffered-descent device 7 is the main structural design thereof, namely, the first buffered-descent device 6 has two segments, namely the first shaft core 62 and the first rotation shaft 611, and the second buffered-descent device 7 has two segments, namely the second shaft core 72 and the second rotation shaft 711, so that each of the first buffered-descent device 6 and the second buffered-descent device 7 is capable of fitting with both the upper lid 4 and the oval seat 5.

Furthermore, sectional shapes of the outer ends of the first shaft core 62 and the second shaft core 72 are the same; each fixing block 2 is provided with a splined hole 23 which passes through two sides of said fixing block 2; a shape of each splined hole 23 matches with a shape of the outer end of each of the first shaft core 62 and the second shaft core 72; therefore, each fixing block 2 is capable of fitting with any one of the first buffered-descent device 6 and second buffered-descent device 7.

Furthermore, the first buffered-descent modules c fitted with the child seat body 31 are also embodied as any one of or a mixture of the first buffered-descent device 6 and the second buffered-descent device 7; namely, the child seat 3 is in a buffered-descent connection with the fixing blocks 2 through the first buffered-descent modules c which are of the same type as the second buffered-descent modules d used by the upper lid 5 and the oval seat 5, so as to reduce a number of types of components in the present invention and enhance versatility of the components thereof. In other words, the two first buffered-descent modules c being fitted with the child seat body 31 are: (1) two first buffered-descent devices 6, (2) two second buffered-descent devices 7, or (3) one first buffered-descent device 6 and one second buffered-descent device 7; in the embodiment illustrated by the figures, the child seat body 31 of the present embodiment is fitted with one first buffered-descent device 6 and one second buffered-descent device 7, wherein the two first shaft sleeves 311 are fitted with the first shaft shell 61 and the second shaft shell 71 respectively.

Figure 13:
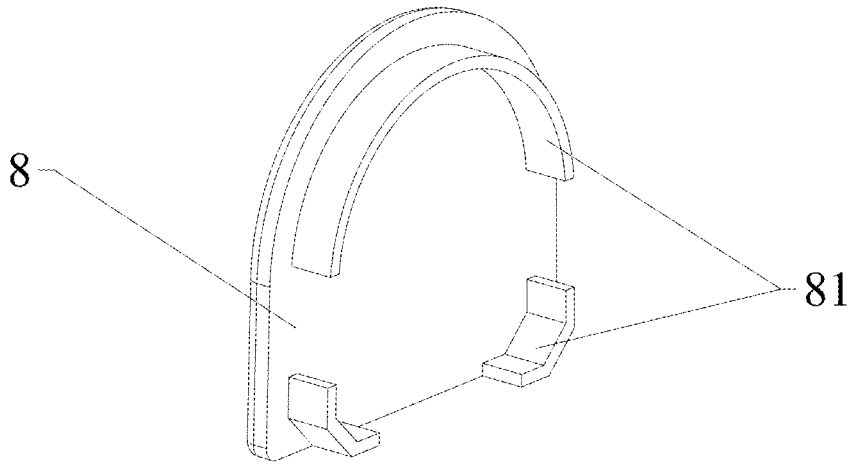
FIG. 13 shows a perspective view of the second decorative lid of the embodiment of the present invention.

The present invention further comprises second decorative lids 8 as illustrated in FIG. 13; each second decorative lid 8 matches with one side of a corresponding second shaft sleeve 11; the second decorative lids 8 are fixed to the second shaft sleeves 11 respectively after detaching the child seat 3; one side of each second decorative lid 8 is provided with a plurality of fixing ribs 81 which fit with inner walls of a corresponding second shaft sleeve 11; a bottom side of the supporting base 1 is provided with a storage groove 12 to store the second decorative lids 8. When the child seat 3 is in use, the second decorative lids 8 are stored inside the storage groove 12 on the bottom side of the supporting base 1, so that the second decorative lids 8 will not be lost easily; when the child seat 3 is not in use, an exposed side of each second shaft sleeve 11 can be covered by a corresponding second decorative lid 8, thus providing the present invention with a tidy appearance.

Figure 14:
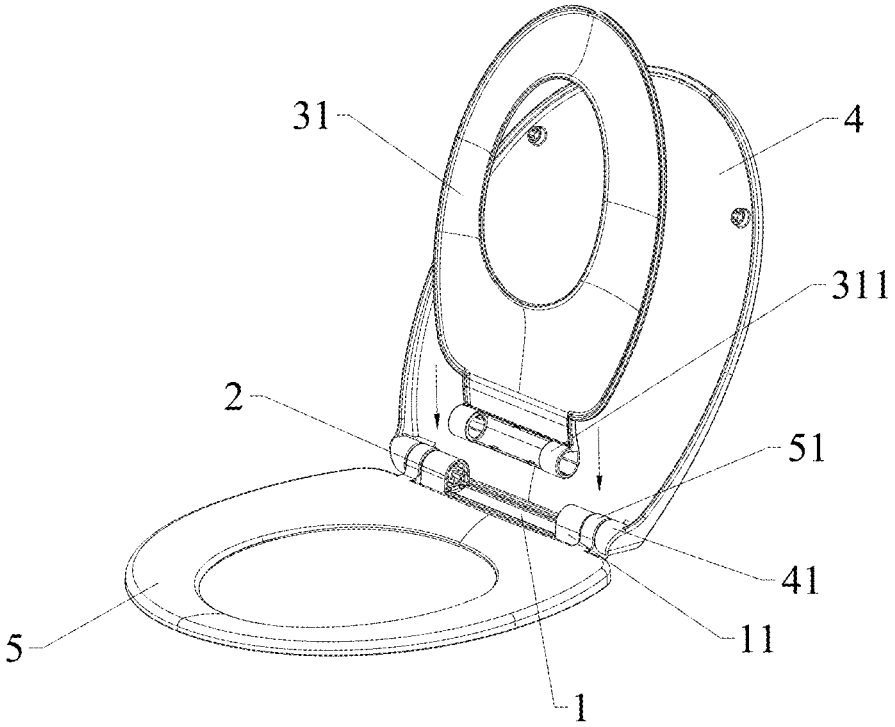
FIG. 14 shows an assembling process of the child seat of the embodiment of the present invention in a perspective view.
Figure 15:
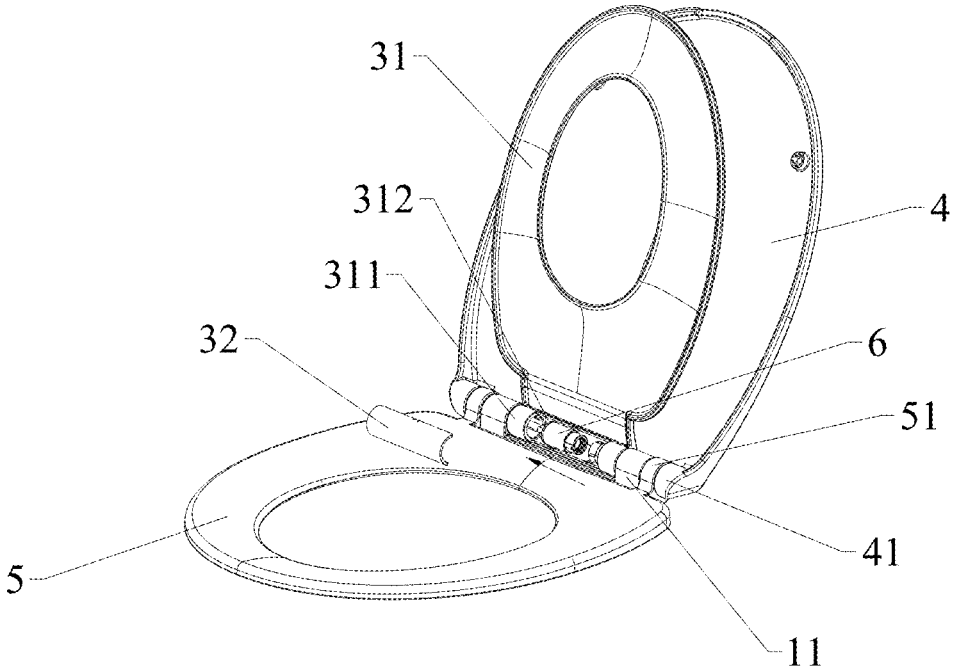
FIG. 15 shows an assembling process of the first buffered-descent device of the child seat of the embodiment of the present invention in a perspective view.
Figure 16:
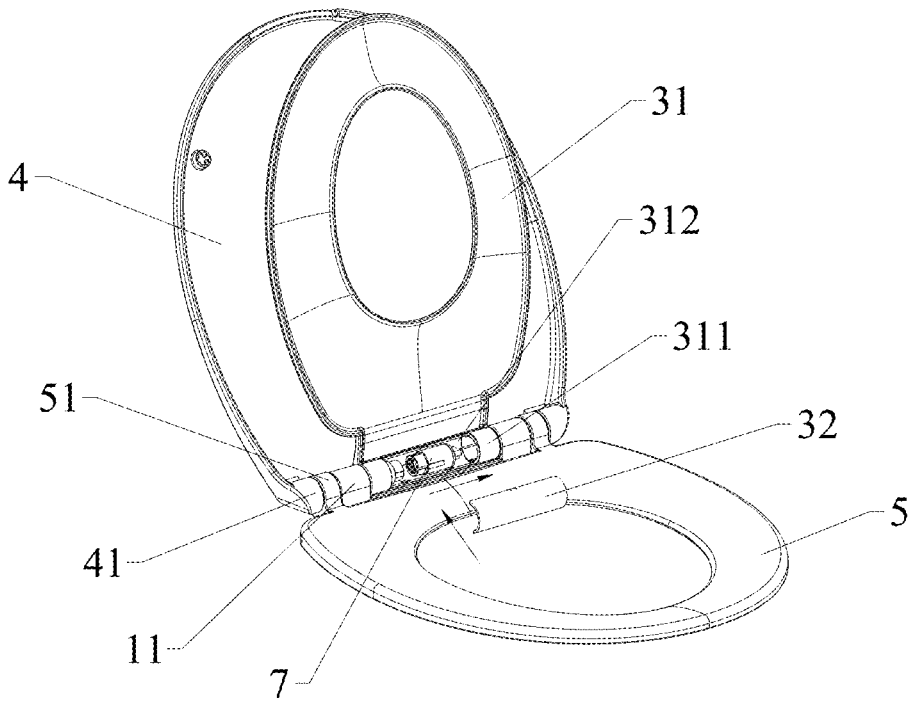
FIG. 16 shows an assembling process of the second buffered-descent device of the child seat of the embodiment of the present invention in a perspective view.
Figure 17:
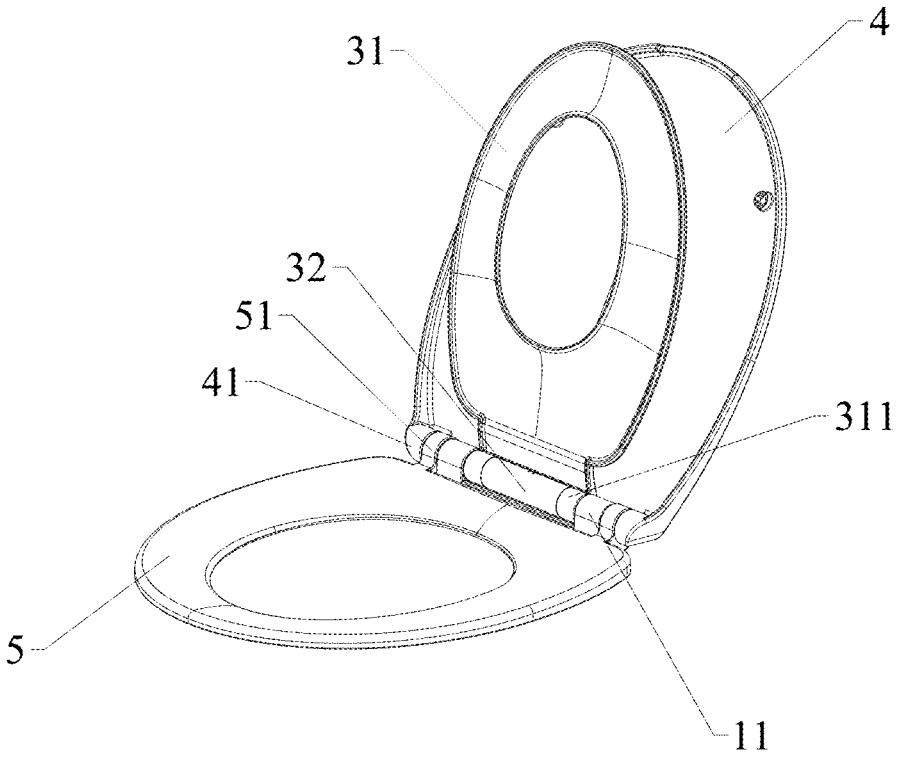
FIG. 17 shows a perspective view of the embodiment of the present invention after assembling the child seat and the first decorative lid.
Figure 18:
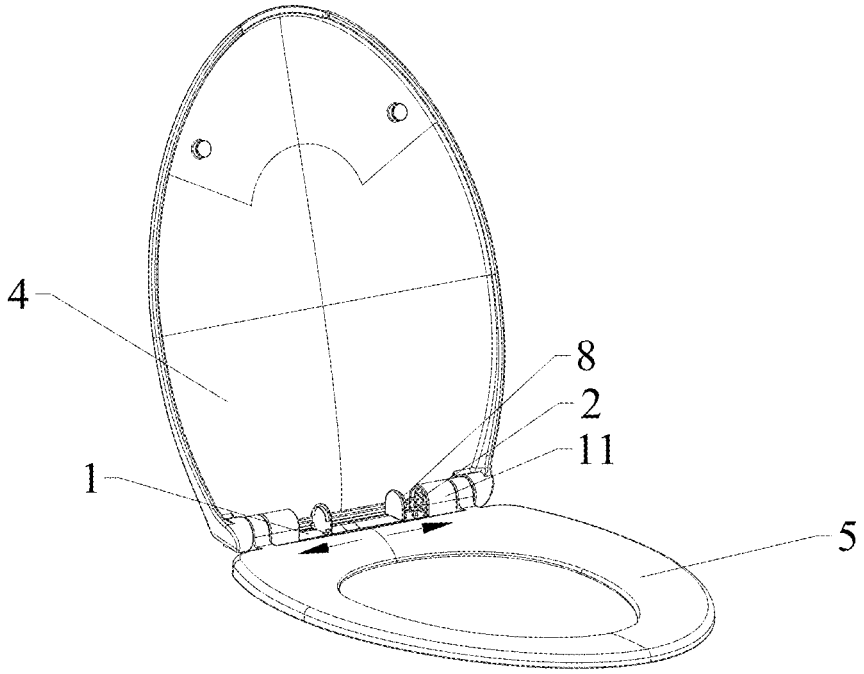
FIG. 18 shows a process of disassembling the child seat and assembling the second decorative lids of the embodiment of the present invention in a perspective view.
Figure 19:
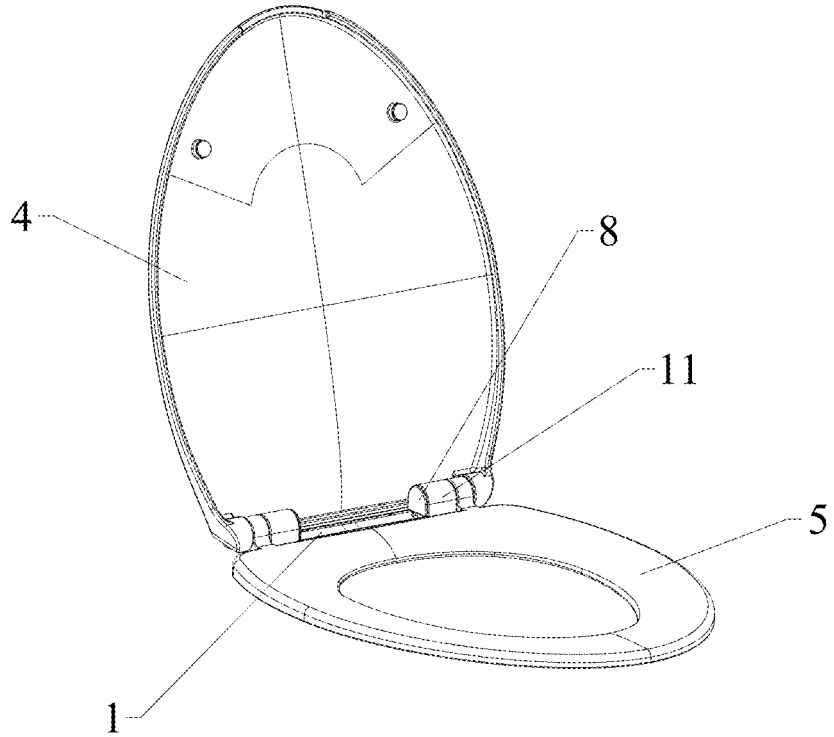
FIG. 19 shows a perspective view of the embodiment of the present invention after disassembling the child seat and assembling the second decorative lids.

As illustrated in FIGS. 14-17, an assembling process of the child seat 3 of the present invention is as follows:

As illustrated in FIG. 14, placing the child seat 3 in an approximately vertical position; moving the shaft portion 310 downward and aligning the shaft portion 310 with the second shaft sleeves 11;

As illustrated in FIG. 15, putting a first buffered-descent device 6 into the sliding groove 312; sliding said first buffered-descent device 6 into a corresponding second shaft sleeve 11 on a left side, and then connecting the first buffered-descent device 6 with a corresponding fixing block 2 on a left side;

As illustrated in FIG. 16, putting a second buffered-descent device 7 into the sliding groove 312; sliding said second buffered-descent device 7 into a corresponding second shaft sleeve 11 on a right side, and then connecting the second buffered-descent device 7 with the fixing block 2 on a right side; then, covering the sliding groove 312 with the first decorative lid 32; a result is as illustrated in FIG. 17;

As illustrated in FIG. 18, when the child seat 3 is not in use, removing the child seat 3, and then covering an end (an exposed side) of each second shaft sleeve 11 to conceal the fixing block 2 inside with a corresponding second decorative lid 8; a result is as illustrated in FIG. 19.

Through the above solutions, each of the first buffered-descent modules c inside the shaft portion 310 of the child seat body 31 is connected with the fixing block 2 inside a corresponding first shaft sleeve 311 of the supporting base 1, so as to fix the child seat body 31 and provide the child seat body 31 with a buffered-descent function; the child seat 3 is capable of buffered descent through the first buffered-descent modules c, and thus will not descend quickly and produce loud noise when being used by children; when the child seat 3 is not needed, a quick disassembly of the child seat 3 can be completed by simply opening the first decorative lid 32 and pulling out the first buffered-descent modules c along an axial direction of the sliding groove to release the shaft portion 310; by analogy, it is also very convenient to assemble the child seat 3.

What is claimed is:

1. A toilet seat structure, comprising a supporting base, a toilet seat, fixing blocks and two first buffered-descent modules;

the toilet seat comprises a child seat; the child seat comprises a child seat body and a first decorative lid; a rear end of the child seat body is provided with a shaft portion in a hollow structure; the shaft portion comprises two first shaft sleeves provided at two ends of the shaft portion respectively, and a sliding groove provided between the two first shaft sleeves; the first decorative lid is detachably fitted with an opening part of the sliding groove;

each of two ends of the supporting base is provided with a second shaft sleeve respectively; each second shaft sleeve is embedded with a corresponding fixing block; each fixing block is circumferentially limited by a corresponding second shaft sleeve;

the two first buffered-descent modules are embedded inside the shaft portion through the sliding groove; each of the first buffered-descent modules passes through a corresponding first shaft sleeve at one of two ends of the sliding groove, and is connected to one side of a corresponding fixing block, thus enabling each first shaft sleeve and a corresponding second shaft sleeve to form a buffered-descent connection.

2. The toilet seat structure of claim 1, wherein when the child seat body is in a closed state, the opening part of the sliding groove is facing downward.

3. The toilet seat structure of claim 1, wherein at least one first buckle groove is provided on each of two sides of the sliding groove along an axial direction thereof; the first decorative lid is provided with at least one first buckle each matching with a corresponding first buckle groove; each first buckle buckles to a corresponding first buckle groove.

4. The toilet seat structure of claim 1, wherein two limiting boards are symmetrically arranged on an inner side of the first decorative lid corresponding to first ends of the two first buffered-descent modules respectively.

5. The toilet seat structure of claim 1, wherein a guiding rib is provided on each of two side walls of each fixing block respectively; a guiding groove matching with a corresponding guiding rib is provided on each of two inner side walls of each second shaft sleeve; each guiding rib is slidable in a corresponding guiding groove; a second buckle groove is provided on a bottom side of each fixing block; a second buckle matching with a corresponding second buckle groove is provided on a bottom wall of each second shaft sleeve; each second buckle buckles to a corresponding second buckle groove.

6. The toilet seat structure of claim 1, further comprising two second buffered-descent modules; the toilet seat further comprises an upper lid and an oval seat; a third shaft sleeve is provided on each of two sides of a rear end of the upper lid; a forth shaft sleeve is provided on each of two sides of a rear end of the oval seat; all third shaft sleeves, all forth shaft sleeves, and all second shaft sleeves are all coaxial; each third shaft sleeve and a corresponding forth shaft sleeve on a same side share one of the second buffered-descent modules which forms a buffered-descent connection with the fixing block inside the corresponding second shaft sleeve.

7. The toilet seat structure of claim 6, wherein the two second buffered-descent modules are any one of or a mixture of a first buffered-descent device and a second buffered-descent device; the first buffered-descent device comprises a first shaft shell filled with damping oil, and a first shaft core in a sealed rotary connection with one end of the first shaft shell, another end of the first shaft shell is provided with a first rotation shaft, a peripheral surface of the first rotation shaft is provided with a first rotation-stopping protruding edge; the second buffered-descent device comprises a second shaft shell filled with damping oil, and a second shaft core in a sealed rotary connection with one end of the second shaft shell, another end of the second shaft shell is provided with a second rotation shaft, a peripheral surface of the second shaft shell is provided with a second rotation-stopping protruding edge; an outer end of each of the first shaft core and the second shaft core is connected with another side of a corresponding fixing block respectively, wherein said another side of the corresponding fixing block is opposite to said one side of the corresponding fixing block connected with a corresponding first buffered-descent module; the two third shaft sleeves of the upper lid are fitted with the first rotation shaft and the second rotation shaft respectively; the two forth shaft sleeves of the oval seat are fitted with the first shaft shell and the second shaft shell respectively.

8. The toilet seat structure of claim 7, wherein sectional shapes of the outer ends of the first shaft core and the second shaft core are the same; each fixing block is provided with a splined hole which passes through two sides of said fixing block; a shape of each splined hole matches with a shape of the outer end of each of the first shaft core and the second shaft core.

9. The toilet seat structure of claim 7, wherein the first buffered-descent modules fitted with the child seat body are also any one of or a mixture of the first buffered-descent device and the second buffered-descent device.

10. The toilet seat structure of claim 1, further comprising second decorative lids; each second decorative lid matches with one side of a corresponding second shaft sleeve; the second decorative lids are configured to be fixed to the second shaft sleeves respectively after detaching the child seat; one side of each second decorative lid is provided with a plurality of fixing ribs which fit with inner walls of a corresponding second shaft sleeve; a bottom side of the supporting base is provided with a storage groove to store the second decorative lids.

* * * * *